US006048451A

United States Patent [19]

Huff, Jr. et al.

[11] Patent Number: 6,048,451

[45] Date of Patent: Apr. 11, 2000

[54] SULFUR REMOVAL PROCESS

[75] Inventors: George A. Huff, Jr., Naperville; Bruce D. Alexander, Lombard; Douglas N. Rundell, Glen Ellyn; William J. Reagan, Naperville; Ozie S. Owen, Aurora; Jin S. Yoo, Flossmoor, all of Ill.

[73] Assignee: BP Amoco Corporation, Chicago, Ill.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/783,221

[22] Filed: Jan. 14, 1997

[51] Int. Cl.[7] ..... C10G 24/20

[52] U.S. Cl. ..... 208/237; 208/208 R; 208/211; 208/232; 208/220; 208/245; 208/238

[58] Field of Search ..... 208/222, 232, 208/237, 208 R, 211, 20, 245, 238

[56] References Cited

U.S. PATENT DOCUMENTS

| | | | |
|---|---|---|---|
| 2,429,575 | 10/1947 | Appleby et al. | 260/683.6 |
| 2,448,211 | 8/1948 | Caesar et al. | 260/329 |
| 2,469,823 | 5/1949 | Hansford et al. | 260/329 |
| 2,482,084 | 9/1949 | Caesar et al. | 260/329 |
| 2,527,794 | 10/1950 | Caesar et al. | 260/329 |
| 2,529,298 | 11/1950 | Kreuz et al. | 260/329 |
| 2,531,280 | 11/1950 | Kreuz | 260/329 |
| 2,563,087 | 8/1951 | Vesely | 260/329 |
| 2,570,542 | 10/1951 | Gerald et al. | 260/329 |
| 2,677,648 | 5/1954 | Lien et al. | 196/28 |
| 2,921,081 | 1/1960 | Zimmerschied et al. | 260/329 |
| 2,943,094 | 6/1960 | Birch et al. | 260/329 |
| 4,171,260 | 10/1979 | Farcasiu et al. | 208/240 |
| 4,307,254 | 12/1981 | Smith, Jr. | 568/697 |
| 4,775,462 | 10/1988 | Imai et al. | 208/189 |
| 5,120,890 | 6/1992 | Sachtler et al. | 585/449 |
| 5,171,916 | 12/1992 | Le et al. | 585/467 |
| 5,336,820 | 8/1994 | Owen et al. | 585/323 |
| 5,599,441 | 2/1997 | Collins et al. | 208/208 R |
| 5,837,131 | 11/1998 | Clark | 208/216 |

FOREIGN PATENT DOCUMENTS

| | | | |
|---|---|---|---|
| 0 359 874 A1 | 3/1990 | European Pat. Off. | C10G 29/20 |
| 863539 | 3/1961 | United Kingdom . | |

OTHER PUBLICATIONS

"Sulfuric Acid For Removing the Different Forms of Sulfur," *Oil and Gas Journal,* Nov. 10, 1938, p. 45.
W.G. Applebury et al., "Alkylation of Thiophene with Olefins," *J. Am. Chem. Soc.,* vol. 70, (1948), pp. 1552–1555.
G.E. Mapstone, "The Chemistry of the Acid Treatment of Gasoline," *Petroleum Refiner,* vol. 29, No. 11 (Nov., 1950), pp. 142–150.
*Friedel–Crafts and Related Reactions,* G.A. Olah, Ed., Interscience Publishers, New York, vol. II, "Alkylation and Related Reactions, Part 1," (1964) pp. 104–109.
F. Asinger, *Mono–Olefins,* Pergamon Press, Oxford (1968), p. 976.

*Primary Examiner*—Helane Myers
*Attorney, Agent, or Firm*—Richard A. Kretchmer; Frank J. Sroka

[57] ABSTRACT

A product of reduced sulfur content is produced from a feedstock which is comprised of a mixture of hydrocarbons and contains organic sulfur compounds as unwanted impurities. The process comprises converting at least a portion of the sulfur-containing impurities to sulfur-containing products of higher boiling point by treatment with an alkylating agent in the presence of an acid catalyst and removing at least a portion of these higher boiling products by fractional distillation. Suitable alkylating agents include alcohols and olefins. In a preferred embodiment, catalytic cracking products which contain aromatic sulfur compounds as impurities are used as a feedstock for the process.

39 Claims, 5 Drawing Sheets

SULFUR REMOVAL PROCESS

FIELD OF THE INVENTION

This invention relates to a process for producing a product of reduced sulfur content from a liquid feedstock wherein the feedstock is comprised of a mixture of hydrocarbons and contains organic sulfur compounds as unwanted impurities. More particularly, it involves converting at least a portion of the organic sulfur compounds in the feedstock to products of a higher boiling point and removing these high boiling products by distillation.

BACKGROUND OF THE INVENTION

The catalytic cracking process is one of the major refining operations which is currently employed in the conversion of petroleum to desirable fuels such as gasoline and diesel fuel. The fluidized catalytic cracking process is an example of this type of process wherein a high molecular weight hydrocarbon feedstock is converted to lower molecular weight products through contact with hot, finely-divided solid catalyst particles in a fluidized or dispersed state. Suitable hydrocarbon feedstocks typically boil within the range of from about 205° C. to about 650° C., and they are usually contacted with the catalyst at temperatures in the range from about 450° C. to about 650° C. Suitable feedstocks include various mineral oil fractions such as light gas oils, heavy gas oils, wide-cut gas oils, vacuum gas oils, kerosenes, decanted oils, residual fractions, reduced crude oils and cycle oils which are derived from any of these as well as fractions derived from shale oils, tar sands processing, and coal liquefaction. Products from the process are typically based on boiling point and include light naphtha (boiling between about 10° C. and about 221° C.), kerosene (boiling between about 180° C. and about 300° C.), light cycle oil (boiling between about 221° C. and about 345° C.), and heavy cycle oil (boiling at temperatures higher than about 345° C.).

Not only does the catalytic cracking process provide a significant part of the gasoline pool in the United States, it also provides a large proportion of the sulfur that appears in this pool. The sulfur in the liquid products from this process is in the form of organic sulfur compounds and is an undesirable impurity which is converted to sulfur oxides when these products are utilized as a fuel. These sulfur oxides are objectionable air pollutants. In addition, they can deactivate many of the catalysts that have been developed for the catalytic converters which are used on automobiles to catalyze the conversion of harmful emissions in the engine exhaust to gases which are less objectionable. Accordingly, it is desirable to reduce the sulfur content of catalytic cracking products to the lowest possible levels.

The sulfur-containing impurities of straight run gasolines, which are prepared by simple distillation of crude oil, are usually very different from those in cracked gasolines. The former contain mostly mercaptans and sulfides, whereas the latter are rich in thiophene derivatives.

Low sulfur products are conventionally obtained from the catalytic cracking process by hydrotreating either the feedstock to the process or the products from the process. The hydrotreating process involves treatment with elemental hydrogen in the presence of a catalyst and results in the conversion of the sulfur in the sulfur-containing organic impurities to hydrogen sulfide which can be separated and converted to elemental sulfur. Unfortunately, this type of processing is typically quite expensive because it requires a source of hydrogen, high pressure process equipment, expensive hydrotreating catalysts, and a sulfur recovery plant for conversion of the resulting hydrogen sulfide to elemental sulfur. In addition, the hydrotreating process can result in an undesired destruction of olefins in the feedstock by conversion to saturated hydrocarbons through hydrogenation. This destruction of olefins by hydrogenation is undesirable because it results in the consumption of expensive hydrogen, and the olefins are valuable as high octane components of gasoline. As an example, naphtha of a gasoline boiling range from a catalytic cracking process has a relatively high octane number as a result of the presence of a large olefin content. Hydrotreating such a material causes a reduction in the olefin content in addition to the desired desulfurization, and octane number decreases as the degree of desulfurization increases.

During the early years of the refining industry, sulfuric acid treatment was an important process that was used to remove sulfur, precipitate asphaltic material, and improve stability, color and odor of a wide variety of refinery stocks. At page 3–119 of the *Petroleum Processing Handbook,* W. F. Bland and R. L. Davidson, Ed., McGraw-Hill Book Company, 1967, it is reported that low temperatures (−4° to 10° C.) are used in this process with strong acid, but that higher temperatures (21° to 54° C.) may be practical if material is to be rerun. It is disclosed in the *Oil and Gas Journal,* Nov. 10, 1938, at page 45 that sulfuric acid treatment of naphtha is effective in removing organic sulfur-containing impurities such as isoamyl mercaptan, dimethyl sulfate, methyl-p-toluene sulfonate, carbon disulfide, n-butyl sulfide, n-propyl disulfide, thiophene, diphenyl sulfoxide, and n-butyl sulfone. The chemistry involved in sulfuric acid treatment of gasoline is extensively discussed by G. E. Mapstone in a review article in the *Petroleum Refiner,* Vol. 29, No. 11 (November, 1950) at pp. 142–150. Mapstone reports at page 145 that thiophenes may be alkylated by olefins in the presence of sulfuric acid. He further states that this same reaction appears to have a significant effect in the desulfurization of cracked shale gasoline by treatment with sulfuric acid in that a large proportion of the sulfur reduction obtained occurs on the redistillation of the acid treated gasoline, with the rerun bottoms containing several percent of sulfur.

U.S. Pat. No. 2,448,211 (Caesar et al.) discloses that thiophene and its derivatives can be alkylated by reaction with olefinic hydrocarbons at a temperature between about 140° and about 400° C. in the presence of a catalyst such as an activated natural clay or a synthetic adsorbent composite of silica and at least one amphoteric metal oxide. Suitable activated natural clay catalysts include clay catalysts on which zinc chloride or phosphoric acid have been precipitated. Suitable silica-amphoteric metal oxide catalysts include combinations of silica with materials such as alumina, zirconia, ceria, and thoria. U.S. Pat. No. 2,469,823 (Hansford et al.) teaches that boron trifluoride can be used to catalyze the alkylation of thiophene and alkyl thiophenes with alkylating agents such as olefinic hydrocarbons, alkyl halides, alcohols, and mercaptans. In addition, U.S. Pat. No. 2,921,081 (Zimmerschied et al.) discloses that acidic solid catalysts can be prepared by combining a zirconium compound selected from the group consisting of zirconium dioxide and the halides of zirconium with an acid selected from the group consisting of orthophosphoric acid, pyrophosphoric acid, and triphosphoric acid. It is further disclosed that thiophene can be alkylated with propylene at a temperature of 227° C. in the presence of such a catalyst.

U.S. Pat. No. 2,563,087 (Vesely) discloses that thiophene can be removed from mixtures of this material with aromatic hydrocarbons by selective alkylation of the thiophene and separation of the resulting thiophene alkylate by distillation. The selective alkylation is carried out by mixing the thiophene-contaminated aromatic hydrocarbon with an alkylating agent and contacting the mixture with an alkylation catalyst at a carefully controlled temperature in the range from about −20° C. to about 85° C. It is disclosed that suitable alkylating agents include olefins, mercaptans, mineral acid esters, and alkoxy compounds such as aliphatic alcohols, ethers and esters of carboxylic acids. It is also disclosed that suitable alkylation catalysts include the following: (1) The Friedel-Crafts metal halides, which are preferably used in anhydrous form; (2) a phosphoric acid, preferably pyrophosphoric acid, or a mixture with sulfuric acid in which the volume ratio of sulfuric to phosphoric acid is less than about 4:1; and (3) a mixture of a phosphoric acid, such as orthophosphoric acid or pyrophosphoric acid, with a siliceous adsorbent, such as kieselguhr or a siliceous clay, which has been calcined to a temperature of from about 400° to about 500° C. to form a silico-phosphoric acid combination which is commonly referred to as a solid phosphoric acid catalyst.

U.S. Pat. No. 2,943,094 (Birch et al.) is directed to a method for the removal of alkyl thiophenes from a distillate which consists predominately of aromatic hydrocarbons, and the method involves converting the alkyl thiophenes to sulfur-containing products of a different boiling point which are removed by fractional distillation. The conversion is carried out by contacting the mixture with a catalyst at a temperature in the range from 500 to 650° C., wherein the catalyst is prepared by impregnating alumina with hydrofluoric acid in aqueous solution. It is disclosed that the catalyst functions to: (1) convert alkyl thiophenes to lower alkyl thiophenes and/or unsubstituted thiophene by dealkylation; (2) effect the simultaneous dealkylation and alkylation of alkyl thiophenes; and (3) convert alkyl thiophenes to aromatic hydrocarbons.

U.S. Pat. No. 2,677,648 (Lien et al.) relates to a process for the desulfurization of a high sulfur olefinic naphtha which involves treating the naphtha with hydrogen fluoride to obtain a raffinate, defluorinating the raffinate, and then contacting the defluorinated raffinate with HF-activated alumina. The treatment with hydrogen fluoride is carried out at a temperature in the range from about −51° to −1° C. under conditions which result in the removal of about 10 to 15% of the feedstock as a high sulfur content extract, and about 30 to 40% of the feedstock is simultaneously converted by polymerization and alkylation to materials of the gas oil boiling range. After removal of HF from the raffinate, the raffinate is contacted with an HF-activated alumina at a temperature in the range from about 316 to 482° C. to depolymerize and dealkylate the gas oil boiling range components and to effect additional desulfurization.

U.S. Pat. No. 4,775,462 (Imai et al.) is directed to a method for converting the mercaptan impurities in a hydrocarbon fraction to less objectionable thioethers which are permitted to remain in the product. This process involves contacting the hydrocarbon fraction with an unsaturated hydrocarbon in the presence of an acid-type catalyst under conditions which are effective to convert the mercaptan impurities to thioethers. It is disclosed that suitable acid-type catalysts include: (1) acidic polymeric resins such as resins which contain a sulfonic acid group; (2) acidic intercalate compounds such as antimony halides in graphite, aluminum halides in graphite, and zirconium halides in graphite; (3) phosphoric acid, sulfuric acid or boric acid supported on silica, alumina, silica-aluminas or clays; (4) aluminas, silica-aluminas, natural and synthetic pillared clays, and natural and synthetic zeolites such as faujasites, mordenites, L, omega, X and Y zeolites; (5) aluminas or silica-aluminas which have been impregnated with aluminum halides or boron halides; and (6) metal sulfates such as zirconium sulfate, nickel sulfate, chromium sulfate, and cobalt sulfate.

SUMMARY OF THE INVENTION

Hydrotreating is an effective method for the removal of sulfur-containing impurities from hydrocarbon liquids such as those which are conventionally encountered in the refining of petroleum and those which are derived from coal liquefaction and the processing of oil shale or tar sands. Liquids of this type, which boil over a broad or narrow range of temperatures within the range from about 10° C. to about 345° C., are referred to herein as "distillate hydrocarbon liquids." For example, light naphtha, heavy naphtha, kerosene and light cycle oil are all distillate hydrocarbon liquids. Unfortunately, hydrotreating is an expensive process and is usually unsatisfactory for use with highly olefinic distillate hydrocarbon liquids. Accordingly, there is a need for an inexpensive process for the removal of sulfur-containing impurities from distillate hydrocarbon liquids. There is also a need for such a process which can be used to remove sulfur-containing impurities from highly olefinic distillate hydrocarbon liquids.

We have found that many of the sulfur-containing impurities which are typically found in distillate hydrocarbon liquids can be easily and selectively converted to sulfur-containing materials of a higher boiling point by treatment with an acid catalyst in the presence of olefins or alcohols. We have also found that a large portion of the resulting higher boiling sulfur-containing materials can be removed by fractional distillation.

One embodiment of the invention is a method for producing a product of reduced sulfur content from a liquid feedstock, wherein said feedstock is comprised of a mixture of hydrocarbons which boils below about 345° C. and contains a minor amount of organic sulfur compounds, and wherein said process comprises: (a) adjusting the composition of said feedstock so that it contains an amount of alkylating agent which is at least equal on a molar basis to that of the organic sulfur compounds, and wherein said alkylating agent is comprised of at least one material selected from the group consisting of alcohols and olefins; (b) contacting the resulting mixture with an acidic solid catalyst at a temperature in excess of 100° C. for a contact time which is effective to result in conversion of at least a portion of said organic sulfur compounds to a higher boiling sulfur-containing material; and (c) fractionally distilling the product of said contacting step to remove high boiling sulfur-containing material and produce a product which has a reduced sulfur content relative to that of said feedstock.

Another embodiment of the invention is a method for producing a product of reduced sulfur content which comprises: (a) producing catalytic cracking products which include sulfur-containing impurities by catalytically cracking a hydrocarbon feedstock which contains sulfur-containing impurities; (b) separating at least a portion of the catalytic cracking products which is comprised of at least 1 weight percent of olefins and contains organic sulfur compounds as impurities; (c) contacting the separated catalytic cracking products with an acidic solid catalyst at a temperature in excess of 50° C. for a period of time which is effective to convert at least a portion of the sulfur-containing impurities in said separated catalytic cracking products to a sulfur-containing material of higher boiling point; and (d)

fractionally distilling the product of said contacting step to remove high boiling sulfur-containing material and produce a product which has a reduced sulfur content relative to that of said separated catalytic cracking products.

A further embodiment of the invention is a method for producing a product of reduced sulfur content which comprises: (a) producing catalytic cracking products by catalytically cracking a hydrocarbon feedstock which contains sulfur-containing impurities; (b) passing the catalytic cracking products to a distillation unit and fractionating said catalytic cracking products into at least two fractions which comprise: (1) a liquid boiling below about 345° C. which contains sulfur-containing impurities and (2) material of higher boiling point; (c) producing a treated liquid by contacting a portion of said fraction (1) from the distillation unit with an acidic solid catalyst at a temperature in excess of 50° C. for a period of time which is effective to convert at least a portion of the sulfur-containing impurities in said fraction (1) to a sulfur-containing material of higher boiling point; and (d) returning the treated liquid to said distillation unit and fractionating the treated liquid simultaneously with the catalytic cracking products, whereby at least a portion of the sulfur-containing material of higher boiling point in the treated liquid is removed and a product of reduced sulfur content is produced.

An object of the invention is to provide a method for the removal of sulfur-containing impurities from distillate hydrocarbon liquids which does not involve hydrotreating with hydrogen in the presence of a hydrotreating catalyst.

An object of the invention is to provide an inexpensive method for producing distillate hydrocarbon liquids of a reduced sulfur content.

Another object of the invention is to provide a method for the removal of mercaptans, thiophene and thiophene derivatives from distillate hydrocarbon liquids.

Another object of the invention is to provide an improved method for the removal of sulfur-containing impurities from catalytic cracking products.

A further object of the invention is to provide a method for the removal of sulfur-containing impurities from the light naphtha product of a catalytic cracking process without significantly reducing its octane.

DETAILED DESCRIPTION OF THE INVENTION

Figure 1:
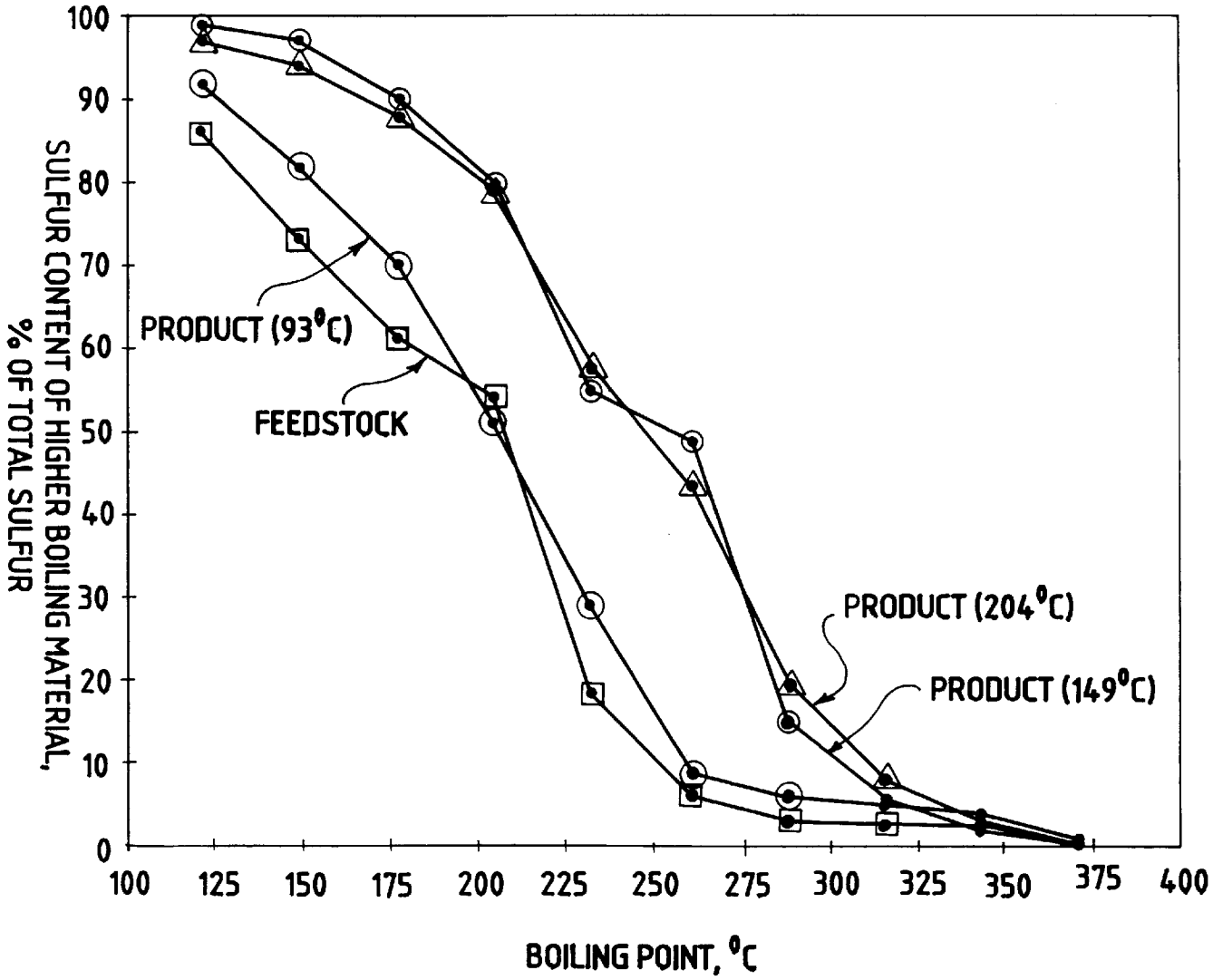
FIG. 1 of the drawings illustrates the use of a solid phosphoric acid catalyst on kieselguhr to increase the boiling point of sulfur-containing impurities in a stabilized heavy naphtha feedstock that was blended with a mixture of $C_3$ and $C_4$ olefins.

We have discovered a process for the production of a product of reduced sulfur content from a liquid feedstock wherein the feedstock is comprised of a mixture of hydrocarbons and contains organic sulfur compounds as unwanted impurities. This process comprises converting at least a portion of the sulfur-containing impurities to sulfur-containing products of a higher boiling point by treatment with an alkylating agent in the presence of an acid catalyst and removing at least a portion of these higher boiling products by distillation.

Suitable alkylating agents for use in the practice of this invention include both alcohols and olefins. However, olefins are generally preferred since they are usually more reactive than alcohols and can be used in the subject process under milder reaction conditions. Suitable olefins include cyclic olefins, substituted cyclic olefins, and olefins of formula I wherein $R_1$ is a hydrocarbyl group and each $R_2$ is independently selected from the group consisting of hydrogen and hydrocarbyl groups. Preferably, $R_1$ is an alkyl group and each $R_2$ is independently selected from the group consisting of hydrogen and alkyl groups. Examples of suitable cyclic olefins and substituted cyclic olefins include cyclopentene, 1-methylcyclopentene, cyclohexene, 1-methylcyclohexene, 3-methylcyclohexene, 4-methylcyclohexene, cycloheptene, cyclooctene, and 4-methylcyclooctene. Examples of suitable olefins of the type of formula I include propene, 2-methylpropene, 1-butene, 2-butene, 2-methyl-1-butene, 3-methyl-1-butene, 2-methyl-2-butene, 2,3-dimethyl-1-butene, 3,3-dimethyl-1-butene, 2,3-dimethyl-2-butene, 2-ethyl-1-butene, 2-ethyl-3-methyl-1-butene, 2,3,3-trimethyl-1-butene, 1-pentene, 2-pentene, 2-methyl-1-pentene, 3-methyl-1-pentene, 4-methyl-1-pentene, 2,4-dimethyl-1-pentene, 1-hexene, 2-hexene, 3-hexene, 1,3-hexadiene, 1,4-hexadiene, 1,5-hexadiene, 2,4-hexadiene, 1-heptene, 2-heptene, 3-heptene, 1-octene, 2-octene, 3-octene, and 4-octene. Secondary and tertiary alcohols are highly preferred over primary alcohols because they are usually more reactive than the primary alcohols and can be used under milder reaction conditions. Materials such as ethylene, methanol and ethanol are less useful than most other olefins and alcohols in the practice of this invention because of their low reactivity.

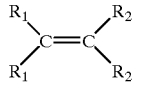

(I)

Preferred alkylating agents will contain from about 3 to about 20 carbon atoms, and highly preferred alkylating agents will contain from about 3 to about 10 carbon atoms. The optimal number of carbon atoms in the alkylating agent will usually be determined by both the boiling point of the desired liquid hydrocarbon product and the boiling point of the sulfur-containing impurities in the feedstock. As previously stated, sulfur-containing impurities are converted by the alkylating agents of this invention to sulfur-containing materials of a higher boiling point. However, alkylating agents which contain a large number of carbon atoms ordinarily result in a larger increase in the boiling point of these products than alkylating agents which contain a smaller number of carbon atoms. Accordingly, an alkylating agent must be selected which will convert the sulfur-containing impurities to sulfur-containing products which are of a sufficiently high boiling point that they can be removed by distillation. For example, propylene may be a highly satisfactory alkylating agent for use in the preparation of a liquid hydrocarbon product of reduced sulfur content which has a maximum boiling point of 150° C. but may not be satisfactory for a liquid hydrocarbon product which has a maximum boiling point of 345° C.

In a preferred embodiment, a mixture of alkylating agents, such as a mixture of olefins or of alcohols, will be used in the practice of this invention. Such a mixture will often be cheaper and/or more readily available than a pure olefin or alcohol and will often yield results which are equally satisfactory to what can be achieved with a pure olefin or alcohol as the alkylating agent. However, when it is desired to optimize the removal of specific sulfur-containing impurities from a specific hydrocarbon liquid, it may be advantageous to utilize a specific olefin or alcohol which is selected to: (1) convert the sulfur-containing impurities to products which have a sufficiently increased boiling point that they can be easily removed by fractional distillation; and (2) permit easy removal of any unreacted alkylating agent, such as by distillation or by aqueous extraction, in the event that this material must be removed. It will be appreciated, of course, that in many refinery applications of the invention, it will not be necessary to remove unreacted alkylating agent from the resulting distillate products of reduced sulfur content.

Although the invention is not to be so limited, it is believed that the principal mechanism for conversion of the sulfur-containing impurities to higher boiling products involves the alkylation of these impurities with the alkylating agent. By way of example, simple alkylation of an aromatic sulfur compound such as thiophene would yield an alkyl-substituted thiophene. This type of reaction is illustrated in equations II and III wherein the conversion of thiophene to 2-isopropylthiophene is illustrated using propene and 2-propanol, respectively, as the alkylating agent. It will be appreciated, of course, that monoalkylation of thiophene can take place either α or β to the sulfur atom, and that polyalkylation can also take place. The alkylation of a mercaptan would yield a sulfide, and this type of reaction is illustrated in equations IV and V wherein the conversion of n-butylmercaptan to isopropyl(n-butyl)sulfide is illustrated using propene and 2-propanol, respectively, as the alkylating agent.

(II)

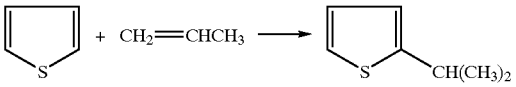

-continued (III)

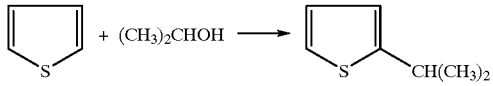

(IV)

$$CH_3(CH_2)_3SH + CH_2{=}CHCH_3 \longrightarrow CH_3(CH_2)_3SCH(CH_3)_2$$

(V)

$$CH_3(CH_2)_3SH + (CH_3)_2CHOH \longrightarrow CH_3(CH_2)_3SCH(CH_3)_2$$

The alkylation process results in the substitution of an alkyl group for a hydrogen atom in the sulfur-containing starting material and causes a corresponding increase in molecular weight over that of the starting material. The higher molecular weight of such an alkylation product is reflected by a higher boiling point relative to that of the starting material. For example, the conversion of thiophene to 2-t-butylthiophene by alkylation with 2-methylpropene results in the conversion of thiophene, which has a boiling point of 84° C., to a product which has a boiling point of 164° C. and can be easily removed from lower boiling material in the feedstock by fractional distillation. Conversion of thiophene to di-t-butylthiophene by dialkylation with 2-methylpropene results in a product which has an even higher boiling point of about 224° C. Alkylation with alkyl groups that add a large rather than a small number of carbon atoms is preferred since the products will have higher molecular weights and, accordingly, will usually have higher boiling points than products which are obtained through alkylation with the smaller alkyl groups.

Feedstocks which can be used in the practice of this invention include any liquid which is comprised of one or more hydrocarbons and contains organic sulfur compounds, such as mercaptans or aromatic sulfur compounds, as impurities. In addition, a major portion of the liquid should be comprised of hydrocarbons boiling below about 345° C. and preferably below about 230° C. Suitable feedstocks include any of the various complex mixtures of hydrocarbons which are conventionally encountered in the refining of petroleum such as natural gas liquids, naphtha, light gas oils, heavy gas oils, and wide-cut gas oils, as well as hydrocarbon fractions derived from coal liquefaction and the processing of oil shale or tar sands. Preferred feedstocks include the liquid products that contain organic sulfur compounds as impurities which result from the catalytic cracking or coking of hydrocarbon feedstocks.

Aromatic hydrocarbons can be alkylated with the alkylating agents of this invention in the presence of the acidic catalysts of this invention. However, aromatic sulfur compounds and other typical sulfur-containing impurities are much more reactive than aromatic hydrocarbons. Accordingly, in the practice of this invention, it is possible to selectively alkylate the sulfur-containing impurities without significant alkylation of aromatic hydrocarbons which may be present in the feedstock. However, any competitive alkylation of aromatic hydrocarbons can be reduced by reducing the concentration of aromatic hydrocarbons in the feedstock. Accordingly, in a preferred embodiment of the invention, the feedstock will contain less than 50 weight percent of aromatic hydrocarbons. If desired, the feedstock can contain less than about 25 weight percent of aromatic hydrocarbons or even smaller amounts.

Catalytic cracking products are preferred feedstocks for use in the subject invention. Preferred feedstocks of this type include liquids which boil below about 345° C., such as light naphtha, heavy naphtha, distillate and light cycle oil. However, it will also be appreciated that the entire output of volatile products from a catalytic cracking process can be utilized as a feedstock in the subject invention. Catalytic cracking products are a desirable feedstock because they typically contain a relatively high olefin content, which makes it unnecessary to add any additional alkylating agent. In addition, aromatic sulfur compounds are frequently a major component of the sulfur-containing impurities in catalytic cracking products, and aromatic sulfur compounds are easily removed by means of the subject invention. For example, a typical light naphtha from the fluidized catalytic cracking of a petroleum derived gas oil can contain up to about 60% by weight of olefins and up to about 0.5% by weight of sulfur wherein most of the sulfur will be in the form of aromatic sulfur compounds. A preferred feedstock for use in the practice of this invention will be comprised of catalytic cracking products and will be additionally comprised of at least 1 weight percent of olefins. A highly preferred feedstock will be comprised of catalytic cracking products and will be additionally comprised of at least 5 weight percent of olefins. Such feedstocks can be a portion of the volatile products from a catalytic cracking process which are separated by distillation.

The sulfur-containing impurities which can be removed by the process of this invention include but are not limited to mercaptans and aromatic sulfur compounds. Examples of aromatic sulfur compounds include thiophene, thiophene derivatives, benzothiophene, and benzothiophene derivatives, and examples of such thiophene derivatives include 2-methylthiophene, 3-methylthiophene, 2-ethylthiophene and 2,5-dimethylthiophene. In a preferred embodiment of the invention, the sulfur-containing impurities in the feedstock will be comprised of aromatic sulfur compounds and at least about 20% of these aromatic sulfur compounds are converted to higher boiling sulfur-containing material upon contact with the alkylating agent in the presence of the acid catalyst. If desired at least about 50% or even more of these aromatic sulfur compounds can be converted to higher boiling sulfur-containing material in the practice of this invention.

Any acidic material which can catalyze the reaction of an olefin or alcohol with mercaptans, thiophene and thiophene derivatives can be used as a catalyst in the practice of this invention. Solid acidic catalysts are particularly desirable, and such materials include liquid acids which are supported on a solid substrate. The solid acidic catalysts are generally preferred over liquid catalysts because of the ease with which the sulfur-containing feedstock can be contacted with such a material. For example, the feedstock can simply be passed through a particulate fixed bed of a solid acidic catalyst at a suitable temperature. In contrast, the use of a liquid acid on a large scale is frequently more difficult because of the problems which are inherent in handling a corrosive liquid and because of the problems involved in separating the liquid acid from the products which are generated upon contact of the feedstock with the liquid acid catalyst.

Catalysts which are suitable for use in the practice of the invention can be comprised of materials such as acidic polymeric resins, supported acids, and acidic inorganic oxides. Suitable acidic polymeric resins include the polymeric sulfonic acid resins which are well-known in the art and are commercially available. Amberlyst® 35, a product produced by Rohm and Haas Co., is a typical example of such a material.

Supported acids which are useful as catalysts include, but are not limited to, Brönsted acids (examples include phosphoric acid, sulfuric acid, boric acid, HF, fluorosulfonic acid, trifluoromethanesulfonic acid, and dihydroxyfluoroboric acid) and Lewis acids (examples include $BF_3$, $BCl_3$, $AlCl_3$, $AlBr_3$, $FeCl_2$, $FeCl_3$, $ZnCl_2$, $SbF_5$, $SbCl_5$ and combinations of $AlCl_3$ and HCl) which are supported on solids such as silica, alumina, silica-aluminas, zirconium oxide or clays. When liquid acids are employed, the supported catalysts are typically prepared by combining the desired liquid acid with the desired support and drying. Supported catalysts which are prepared by combining a phosphoric acid with a support are highly preferred and are referred to herein as solid phosphoric acid catalysts. These catalysts are preferred because they are both highly effective and low in cost. U.S. Pat. No. 2,921,081 (Zimmerschied et al.), which is incorporated herein by reference, discloses the preparation of solid phosphoric acid catalysts by combining a zirconium compound selected from the group consisting of zirconium oxide and the halides of zirconium with an acid selected from the group consisting of orthophosphoric acid, pyrophosphoric acid and triphosphoric acid. U.S. Pat. No. 2,120,702 (Ipatieff et al.), which is incorporated herein by reference, discloses the preparation of solid phosphoric acid catalysts by combining a phosphoric acid with a siliceous material. Finally, British Patent No. 863,539, which is incorporated herein by reference, also discloses the preparation of a solid phosphoric acid catalyst by depositing a phosphoric acid on a solid siliceous material such as diatomaceous earth or kieselguhr.

Acidic inorganic oxides which are useful as catalysts include, but are not limited to, aluminas, silica-aluminas, natural and synthetic pillared clays, and natural and synthetic zeolites such as faujasites, mordenites, L, omega, X, Y, beta, and ZSM zeolites. Highly suitable zeolites include beta, Y, ZSM-3, ZSM4, ZSM- 5, ZSM-18, and ZSM-20. If desired, the zeolites can be incorporated into an inorganic oxide matrix material such as a silica-alumina. Indeed, equilibrium cracking catalyst can be used as the acid catalyst in the practice of this invention.

Catalysts can comprise mixtures of different materials, such as a Lewis acid (examples include $BF_3$, $BCl_3$, $SbF_5$, and $AlCl_3$), a nonzeolitic solid inorganic oxide (such as silica, alumina and silica-alumina), and a large-pore crystalline molecular sieve (examples include zeolites, pillared clays and aluminophosphates).

Feedstocks which are used in the practice of this invention will occasionally contain nitrogen-containing organic compounds as impurities in addition to the sulfur-containing impurities. Many of the typical nitrogen-containing impurities are organic bases and, in some instances, can cause deactivation of the acid catalyst by reaction with it. In the event that such deactivation is observed, it can be prevented by removal of the basic nitrogen-containing impurities from the feedstock before it is contacted with the acid catalyst.

The basic nitrogen-containing impurities can be removed from the feedstock by any conventional method such as an acid wash or the use of a guard bed which is positioned in front of the acid catalyst. Examples of effective guard beds include A-zeolite, Y-zeolite, L-zeolite, mordenite and acidic polymeric resins. If a guard bed technique is employed, it is often desirable to use two guard beds in such a manner that one guard bed can be regenerated while the other is being used to pretreat the feedstock and protect the acid catalyst. If an acid wash is used to remove basic nitrogen-containing compounds, the feedstock will be treated with an aqueous solution of a suitable acid. Suitable acids for such use include, but are not limited to, hydrochloric acid, sulfuric acid and acetic acid. The concentration of acid in the aqueous solution is not critical, but is conveniently chosen to be in the range from about 0.5 to about 30% by weight.

In the practice of this invention, the feedstock which contains sulfur-containing impurities is contacted with the acid catalyst at a temperature and for a period of time which are effective to result in conversion of at least a portion of the sulfur-containing impurities to a higher boiling sulfur-containing material. Desirably, the contacting temperature will be in excess of about 50° C., preferably in excess of 100° C., and more preferably in excess of 125° C. The contacting will generally be carried out at a temperature in the range from about 50° to about 350° C., preferably from about 100° to about 350° C., and more preferably from about 125° to about 250° C. It will be appreciated, of course, that the optimum temperature will be a function of the acid catalyst used, the alkylating agent or agents selected, and the nature of the sulfur-containing impurities that are to be removed from the feedstock.

The sulfur-containing impurities are highly reactive and can be selectively converted to sulfur-containing products of higher boiling point by reaction with the alkylating agent of this invention. Accordingly, the feedstock can be contacted with the acid catalyst under conditions which are sufficiently mild that most hydrocarbons will be substantially unaffected. For example, aromatic hydrocarbons will be substantially unaffected and significant olefin polymerization will not take place. In the case of a naphtha feedstock from a catalytic cracking process, this means that sulfur-containing impurities can be removed without significantly affecting the octane of the naphtha. However, if desired, the temperature and concentration of alkylating agent can be increased to a point where significant alkylation of aromatic hydrocarbons can also be produced. If, for example, the feedstock contains both sulfur-containing impurities and modest amounts of benzene, the reaction conditions can be selected so that the sulfur-containing impurities are converted to higher boiling products and a major portion of the benzene is converted to alkylation products.

Any desired amount of alkylating agent can be used in the practice of this invention. However, relatively large amounts of alkylating agent relative to the amount of sulfur-containing impurities will promote a rapid and complete conversion of the impurities to higher boiling sulfur-containing products upon contact with the acid catalyst. Before contacting with the acid catalyst, the composition of the feedstock is desirably adjusted so that it contains an amount of alkylating agent which is at least equal on a molar basis to that of the organic sulfur compounds in the feedstock. If desired, the molar ratio of alkylating agent to organic sulfur compounds can be at least 5 or even larger.

In the practice of this invention, the feedstock can be contacted with the acid catalyst at any suitable pressure. However, pressures in the range from about 0.01 to about 200 atmospheres are desirable, and a pressure in the range from about 1 to about 100 atmospheres is preferred. In a highly preferred embodiment of the invention, the temperature and pressure at which the feedstock is contacted with the solid acidic catalyst are selected so that the feedstock is maintained in a liquid state. Although the invention is not to be so limited, it is believed that coke formation is minimized when the feedstock is kept in a liquid state during contacting with the acid catalyst. More specifically, it is believed that coke precursors are dissolved and removed from the catalyst when the feedstock is maintained in the liquid state. In contrast, if the feedstock is contacted with the solid acidic catalyst as a vapor, it is believed that coke precursors can be deposited on the catalyst and remain there until they are ultimately converted to coke which can deactivate the catalyst.

The contacting of the acid catalyst with the feedstock and alkylating agent of this invention can be carried out in any conventional manner. For example, the feedstock and alkylating agent can be contacted with the acid catalyst in a batch process. However, in a highly preferred embodiment, the feedstock and alkylating agent are simply passed through a fixed bed of solid acidic catalyst which is placed either in a vertical or a horizontal reaction zone. Desirably, the solid acidic catalyst will be used in a physical form, such as pellets, beads or rods, which will permit a rapid and effective contacting with the feedstock and alkylating agent without creating substantial amounts of back-pressure. Although the invention is not to be so limited, it is preferred that the catalyst be in particulate form wherein the largest dimension of the particles has an average value which is in the range from about 0.1 mm to about 2 cm. For example, substantially spherical beads of catalyst can be used which have an average diameter from about 0.1 mm to about 2 cm. Alternatively, the catalyst can be used in the form of rods which have a diameter in the range from about 0.1 mm to about 1 cm and a length in the range from about 0.2 mm to about 2 cm.

This invention represents a method for concentrating the sulfur-containing impurities of a hydrocarbon feedstock into a high boiling fraction which is separated by fractional distillation. As a result of concentration, the sulfur can be disposed of more easily and at lower cost, and any conventional method can be used for this disposal. For example, the resulting high sulfur content material can be blended into heavy fuels where the sulfur content will be less objectionable. Alternatively, this high sulfur content material can be efficiently hydrotreated at relatively low cost because of its reduced volume relative to that of the original feedstock.

A highly preferred embodiment of this invention comprises its use to remove sulfur-containing impurities from the hydrocarbon products that occur in the products from the fluidized catalytic cracking of hydrocarbon feedstocks which contain sulfur-containing impurities. The catalytic cracking of heavy mineral oil fractions is one of the major refining operations employed in the conversion of crude oils to desirable fuel products such as high octane gasoline fuels which are used in spark-ignition internal combustion engines. In fluidized catalytic cracking processes, high molecular weight hydrocarbon liquids or vapors are contacted with hot, finely-divided, solid catalyst particles, typically in a fluidized bed reactor or in an elongated riser reactor, and the catalyst-hydrocarbon mixture is maintained at an elevated temperature in a fluidized or dispersed state for a period of time sufficient to effect the desired degree of cracking to low molecular weight hydrocarbons of the kind typically present in motor gasoline and distillate fuels.

Conversion of a selected hydrocarbon feedstock in a fluidized catalytic cracking process is effected by contact with a cracking catalyst in a reaction zone at conversion temperature and at a fluidizing velocity which limits the conversion time to not more than about ten seconds. Conversion temperatures are desirably in the range from about 430° to about 700° C. and preferably from about 450° to about 650° C. Effluent from the reaction zone, comprising hydrocarbon vapors and cracking catalyst containing a deactivating quantity of carbonaceous material or coke, is then transferred to a separation zone. Hydrocarbon vapors are separated from spent cracking catalyst in the separation zone and are conveyed to a fractionator for the separation of these materials on the basis of boiling point. These hydrocarbon products typically enter the fractionator at a temperature in the range from about 430° to about 650° C. and supply all of the heat necessary for fractionation.

In the catalytic cracking of hydrocarbons, some non-volatile carbonaceous material or coke is deposited on the catalyst particles. As coke builds up on the cracking catalyst, the activity of the catalyst for cracking and the selectivity of the catalyst for producing gasoline blending stocks diminishes. The catalyst can, however, recover a major portion of its original capabilities by removal of most of the coke from it. This is carried out by burning the coke deposits from the catalyst with a molecular oxygen-containing regeneration gas, such as air, in a regeneration zone or regenerator.

A wide variety of process conditions can be used in the practice of the fluidized catalytic cracking process. In the usual case where a gas oil feedstock is employed, the throughput ratio, or volume ratio of total feed to fresh feed, can vary from about 1.0 to about 3.0. Conversion level can vary from about 40% to about 100% where conversion is defined as the percentage reduction of hydrocarbons boiling above 221° C. at atmospheric pressure by formation of lighter materials or coke. The weight ratio of catalyst to oil in the reactor can vary within the range from about 2 to about 20 so that the fluidized dispersion will have a density in the range from about 15 to about 320 kilograms per cubic meter. Fluidizing velocity can be in the range from about 3.0 to about 30 meters per second.

A suitable hydrocarbon feedstock for use in a fluidized catalytic cracking process in accordance with this invention can contain from about 0.2 to about 6.0 weight percent of sulfur in the form of organic sulfur compounds. Suitable feedstocks include, but are not limited to, sulfur-containing petroleum fractions such as light gas oils, heavy gas oils, wide-cut gas oils, vacuum gas oils, naphthas, decanted oils, residual fractions and cycle oils derived from any of these as well as sulfur-containing hydrocarbon fractions derived from synthetic oils, coal liquefaction and the processing of oil shale and tar sands. Any of these feedstocks can be employed either singly or in any desired combination.

A preferred embodiment of the present invention involves passing the volatile products from the catalytic cracking of a sulfur-containing feedstock to a fractionator where they are separated on the basis of boiling point into at least two fractions which comprise: (1) a liquid boiling below about 345° C. which contains sulfur-containing impurities, and (2) material of higher boiling point. A treated liquid is then prepared by contacting a portion of fraction (1) with an acidic solid catalyst at a temperature in excess of 50° C. for a period of time which is effective to convert at least a portion of the sulfur-containing impurities in fraction (1) to a sulfur-containing material of higher boiling point. The resulting treated liquid is then returned to the fractionator and fractionated together with the original volatile products from the catalytic cracking process. In this manner, at least a portion of the sulfur-containing material of higher boiling point in the treated liquid is removed in the higher boiling fractions and a product of reduced sulfur content is produced. This embodiment can be thought of as a recycle process wherein a recycle stream from the fractionator is contacted with the acid catalyst in order to convert sulfur-containing impurities to higher boiling products which are then removed in the high boiling fractions from the fractionator. In a highly preferred embodiment, fraction (1) will be a liquid boiling below about 230° C. and fraction (2) will be material of a higher boiling point.

The previously mentioned recycle process embodiment is advantageous because it can be implemented at very low capital cost. More specifically, the recycle stream can be withdrawn from the fractionator at a temperature which is approximately equal to the preferred temperature for use in contacting the recycle stream with the acidic solid catalyst of this invention in order to convert sulfur-containing impurities to higher boiling point products. Accordingly, a furnace, heat exchanger or other means for heating the recycle stream is not required. In addition, a separate fractionator is not required. In the practice of this embodiment, the recycle stream will, preferably, be from about 5% to about 90% by volume of the above-mentioned fraction (1) from the fractionator.

The following examples are intended only to illustrate the invention and are not to be construed as imposing limitations on the invention.

EXAMPLE I

Polymeric sulfonic acid resin. A macroreticular, polymeric, sulfonic acid resin was obtained from the Rohm and Haas Company which is sold under the name Amberlyst® 35 Wet. This material was provided in the form of spherical beads which have a particle size in the range from 0.4 to 1.2 mm and has the following properties: (1) a concentration of acid sites equal to 5.4 meq/g; (2) a moisture content of 56%; (3) a porosity of 0.35 cc/g; (4) an average pore diameter of 300 Å; and a surface area of 44 $m^2/g$. The resin was used as received and is identified herein as Catalyst A.

EXAMPLE II

Solid phosphoric acid alkylation catalyst on kieselguhr. A solid phosphoric acid catalyst on kieselguhr was obtained from UOP which is sold under the name SPA-2. This material was provided in the form of a cylindrical extrudate having a nominal diameter of 4.75 mm and has the following properties: (1) a loaded density of 0.93 $g/cm^3$; (2) a free phosphoric acid content, calculated as $P_2O_5$, of 16 to 20 wt. %; and (3) a nominal total phosphoric acid content, calculated as $P_2O_5$, of 60 wt. %. The catalyst was crushed and sized to 12 to 20 mesh size (U.S. Sieve Series) before use, and is identified herein as Catalyst B.

EXAMPLE III

Preparation of ZSM-5 Zeolite. A solution of 1.70 kg of sodium hydroxide, 26.8 kg of tetrapropyl ammonium bromide, 2.14 kg of sodium aluminate, and 43.5 kg of silica sol (Ludox HS-40 manufactured by E. I. duPont de Nemours Co. Inc.) in 18.0 kg of distilled water was prepared in an autoclave. The autoclave was sealed and maintained at a temperature of about 149° C., autogenous pressure, and a mixer speed of about 60 rpm for a period of about 120 hours. The slurry was filtered and washed, and the resulting filter cake was dried in an oven at 121° C. for a period of 16 hours. The dried filter cake was then calcined at 538° C. for a period of 4 hours. The calcined material was ion exchanged three times with ammonium nitrate in water by heating, under reflux, to a temperature of about 85° C. for a period of one hour, cooling while stirring for 2 hours, filtering, and washing with 1 liter of water, and reexchanging. The resulting solid was washed with 4 liters of water, dried in an oven at 121° C. for a period of 4 hours and calcined at 556° C. for 4 hours to yield ZSM-5 zeolite as a powder.

Preparation of alkylation catalyst comprised of ZSM-5 zeolite in an alumina matrix. A 166 g portion of the above-described ZSM-5 zeolite was mixed with 125 g of Catapal SB alumina (alpha-alumina monohydrate manufactured by Vista). The mixture of solids was added to 600 g of distilled water, mixed well and dried in an oven at 121° C. for a period of 16 hours. The solids were then moistened with distilled water and extruded as a cylindrical extrudate having a diameter of 1.6 mm. The extrudate was dried at 121° C. for 16 hours in a forced air oven and calcined at 538° C. for 4 hours. The resulting material was crushed and sized to 12–20 mesh size (U.S. Sieve Series). This material, which is comprised of ZSM-5 zeolite in an alumina matrix, is identified herein as Catalyst C.

EXAMPLE IV

Preparation of beta zeolite. A solution of 0.15 kg of sodium hydroxide, 22.5 kg of tetraethyl ammonium hydroxide, 0.90 kg of sodium aluminate, and 36.6 kg of silica sol (Ludox HS-40 manufactured by E. I. duPont de Nemours Co. Inc.) in 22.5 kg of distilled water was prepared in an autoclave. The autoclave was sealed and maintained at a temperature of about 149° C., autogenous pressure, and a mixer speed of about 60 rpm for a period of about 96 hours. The slurry was filtered and washed, and the filter cake was dried in an oven at 121° C. for a period of 16 hours. The resulting solid was ion exchanged three times with ammonium nitrate in water by heating, under reflux, to a temperature of about 60° C. for a period of three hours, cooling while stirring for 2 hours, decanting and reexchanging. Upon drying in an oven at 121° C. for a period of 4 hours, the desired beta zeolite was obtained as a powder.

Preparation of alkylation catalyst comprised of beta zeolite in an alumina matrix. An 89.82 g portion of the above-described beta zeolite powder was mixed with 40 grams of Catapal SB alumina (alpha-alumina monohydrate manufactured by Vista). The mixture of solids was added to 300 g of distilled water, mixed well and dried at 121° C. for 16 hours in a forced air oven. The solids were then moistened with distilled water and extruded as a cylindrical extrudate having a diameter of 1.6 mm. The extrudate was dried at 121° C. for 16 hours in a forced air oven and calcined at 538° C. for 3 hours. The resulting material was crushed and sized to 12 to 20 mesh size (U.S. Sieve Series). This material, which is comprised of beta zeolite in an alumina matrix, is identified herein as Catalyst D.

EXAMPLE V

Preparation of silica-alumina alkylation catalyst. A 75.0 g portion of tetraethyl orthosilicate and 500 g of n-hexane were mixed with 375 g of a low silica alumina which had a surface area of 338 $m^2/g$ and was in the form of a cylindrical extrudate having a diameter of 1.3 mm (manufactured by Haldor-Topsoe). The n-hexane was allowed to evaporate at room temperature. The resulting material was dried in a forced air oven at 100° C. for 16 hours and then calcined at 510° C. for 8 hours. The calcined material was impregnated with a solution containing 150 g of ammonium nitrate in 1000 ml of water, allowed to stand for 3 days, dried in a forced air oven at 100° C. for 16 hours and calcined at 538° C. for 5 hours. The resulting material, which is comprised of silica-alumina, is identified herein as Catalyst E.

EXAMPLE VI

Preparation of alkylation catalyst comprised of Y zeolite in an alumina matrix. A 100.12 g portion of LZY-82 zeolite powder (LZY-82 is an ultrastable Y zeolite manufactured by Union Carbide) was dispersed in 553.71 g of PHF alumina sol (manufactured by Criterion Catalyst Company), and the dispersion was dried in a forced air oven at 121° C. for 16 hours. The resulting material was moistened with distilled water and was then extruded as a cylindrical extrudate having a diameter of 1.6 mm. The extrudate was dried at 121° C. for 16 hours in a forced air oven and then calcined at 538° C. for 3 hours. The resulting material was crushed and sized to 12–20 mesh size (U.S. Sieve Series). This material, which is comprised of LZY-82 zeolite in an alumina matrix, is identified herein as Catalyst F.

EXAMPLE VII

The data which are set forth below for the sulfur content of samples as a function of boiling point were obtained using a gas chromatograph equipped with a flame ionization detector, a wide-bore fused-silica capillary column, direct injector, and a sulfur chemiluminescence detector. The analytical method is based on a retention time versus boiling point calibration of the chromatographic system.

The ability of various acidic solid catalysts to convert the sulfur-containing impurities in a hydrocarbon feedstock to sulfur-containing products of a higher boiling point was evaluated using the following feedstocks:

Stabilized Heavy Naphtha. This material, boiling over the range from −21° to about 249° C., was obtained by: (1) partial stripping of the $C_4$ hydrocarbons from a heavy naphtha that was produced by the fluidized catalytic cracking of a gas oil feedstock which contained sulfur-containing impurities; and (2) treatment with caustic to remove mercaptans. Analysis of the stabilized heavy naphtha using a multicolumn gas chromatographic technique showed it to contain on a weight basis: 4% paraffins, 18% isoparaffins, 15% olefins, 15% naphthenes, 45% aromatics, and 3% unidentified $C_{13+}$ high boiling material. The total sulfur content of the stabilized heavy naphtha, as determined by X-ray fluorescence spectroscopy, was 730 ppm. This sulfur content, as a function of boiling point, is set forth in Table I.

TABLE I

Sulfur Content of Heavy Naphtha Feedstock as a Function of Boiling Point

| Amount of Sulfur in Higher Boiling Fractions, wt. % | Temperature, ° C. |
|---|---|
| 95 | 113 |
| 90 | 114 |
| 85 | 132 |
| 80 | 139 |
| 75 | 142 |
| 70 | 163 |
| 65 | 168 |
| 60 | 182 |
| 55 | 201 |
| 50 | 219 |
| 45 | 220 |
| 40 | 220 |
| 35 | 226 |
| 30 | 227 |
| 25 | 229 |
| 20 | 232 |
| 15 | 233 |
| 10 | 247 |
| 5 | 264 |
| 1 | 365 |

The principal sulfur-containing impurities were identified chromatographically by discrete peak identification, and these results are set forth in Table II.

TABLE II

Principal Sulfur-Containing Impurities In Stabilized Heavy Naphtha Feedstock

| Component | Component Concentration, ppm |
|---|---|
| Thiophene | 18 |
| 2-Methylthiophene | 33 |
| 2-Ethylthiophene | 15 |
| 3-Ethylthiophene | 21 |
| Benzothiophene | 111 |
| Tetrahydrothiophene | 4 |
| 2,5-Dimethylthiophene | 11 |

Experiments with the stabilized heavy naphtha feedstock were carried out using the following procedure. A 7 g portion of the selected catalyst was packed into a 9.5 mm internal diameter tubular reactor which was constructed of stainless steel and held in a vertical orientation. The catalyst bed was placed in the reactor between beds of silicon carbide which were held in place with plugs of quartz wool. Operating temperatures were varied from 93° to 204° C., and the pressure within the reactor was maintained at 75 to 85 atm. The feedstock was introduced at the top of the reactor and was passed downward through the catalyst bed at a space velocity of 1–2 LHSV. A syringe pump was used to inject the feedstock into the reactor. The experimental apparatus included a back-pressure regulator which was downstream from the reactor and was positioned at a higher elevation than the top to the catalyst bed in order to ensure that the catalyst bed was completely filled with liquid.

Synthetic Feedstocks. Two synthetic feedstocks, one of low olefin content and the other of high olefin content, were prepared by blending model compounds which were selected to represent the principal groups of organic compounds which are found in a typical heavy naphtha which is produced by the fluidized catalytic cracking process. The proportions of these principal groups in the high olefin content synthetic feedstock are typical of what would be expected in such a heavy naphtha from a fluidized catalytic cracking process. The synthetic feedstocks are very similar in composition except that the low olefin content synthetic feedstock contains very little olefin. The compositions of these synthetic feedstocks are set forth in Table III.

TABLE III

Composition of Synthetic Feedstocks

| | Component Concentration, wt. % | |
|---|---|---|
| Component | High Olefin Content Feedstock | Low Olefin Content Feedstock |
| 2-Propanethiol | 0.39 | 0.22 |
| 1-Hexene | 4.10 | 0.38 |
| Methylcyclopentane | 8.54 | 6.81 |
| 2,3-Dimethyl-2-butene | 4.17 | 0.44 |
| Benzene | 10.32 | 13.44 |
| Thiophene | 0.49 | 0.41 |
| 1-Heptene | 4.63 | 0.56 |
| n-Heptane | 43.37 | 47.86 |
| Toluene | 22.53 | 28.74 |
| 2-Methylthiophene | 0.45 | 0.50 |
| Isopropyl sulfide | 0.48 | 0.29 |

Experiments with the synthetic feedstocks were carried out using the following procedure. A 10 $cm^3$ volume of the selected catalyst was packed into a 1.43 cm internal diameter tubular reactor which was constructed of stainless steel and held in a vertical orientation. The catalyst bed was placed in the reactor between beds of alpha alumina which were held in place with plugs of quartz wool. Prior to use, catalysts C, D, E and F were activated in the reactor at a temperature of 399° C. in a stream of nitrogen at a flow rate of 200 $cm^3$/min for one hour. Operating temperatures were varied from 93° to 204° C., and the pressure within the reactor was maintained at either 17 or 54 atm. The feedstock was introduced at the bottom of the reactor and was passed upward through the catalyst bed.

EXPERIMENT VIII

The stabilized heavy naphtha feedstock was blended with a mixed $C_3/C_4$ stream (containing, on a weight basis, 55% propane, 27% propene, 9.5% 2-butene, 6% 1-butene and 2.5% 2-methylpropene) at a 1.0 volume ratio of $C_3/C_4$ stream to naphtha. The resulting blend was contacted, as described above, with Catalyst B (solid phosphoric acid catalyst on kieselguhr) at a pressure of 85 atm, a space velocity of 2 LHSV, and at temperatures of 93°, 149° and 204° C. The distribution of sulfur content as a function of boiling point in the feedstock and in the products obtained at reaction temperatures of 93°, 149° and 204° C. is set forth in FIG. 1 (boiling point is plotted as a function of the percentage of the total sulfur content which is present in higher boiling fractions). These results demonstrate that, at a reaction temperature of either 149° or 204° C., the sulfur-containing impurities in the feedstock are converted to higher boiling sulfur-containing products, and that this increase in boiling point is about 25° C. over the entire boiling range of the naphtha. In contrast, there is relatively little conversion of the sulfur-containing impurities to higher boiling products at a reaction temperature of 93° C.

EXPERIMENT IX

Figure 2:
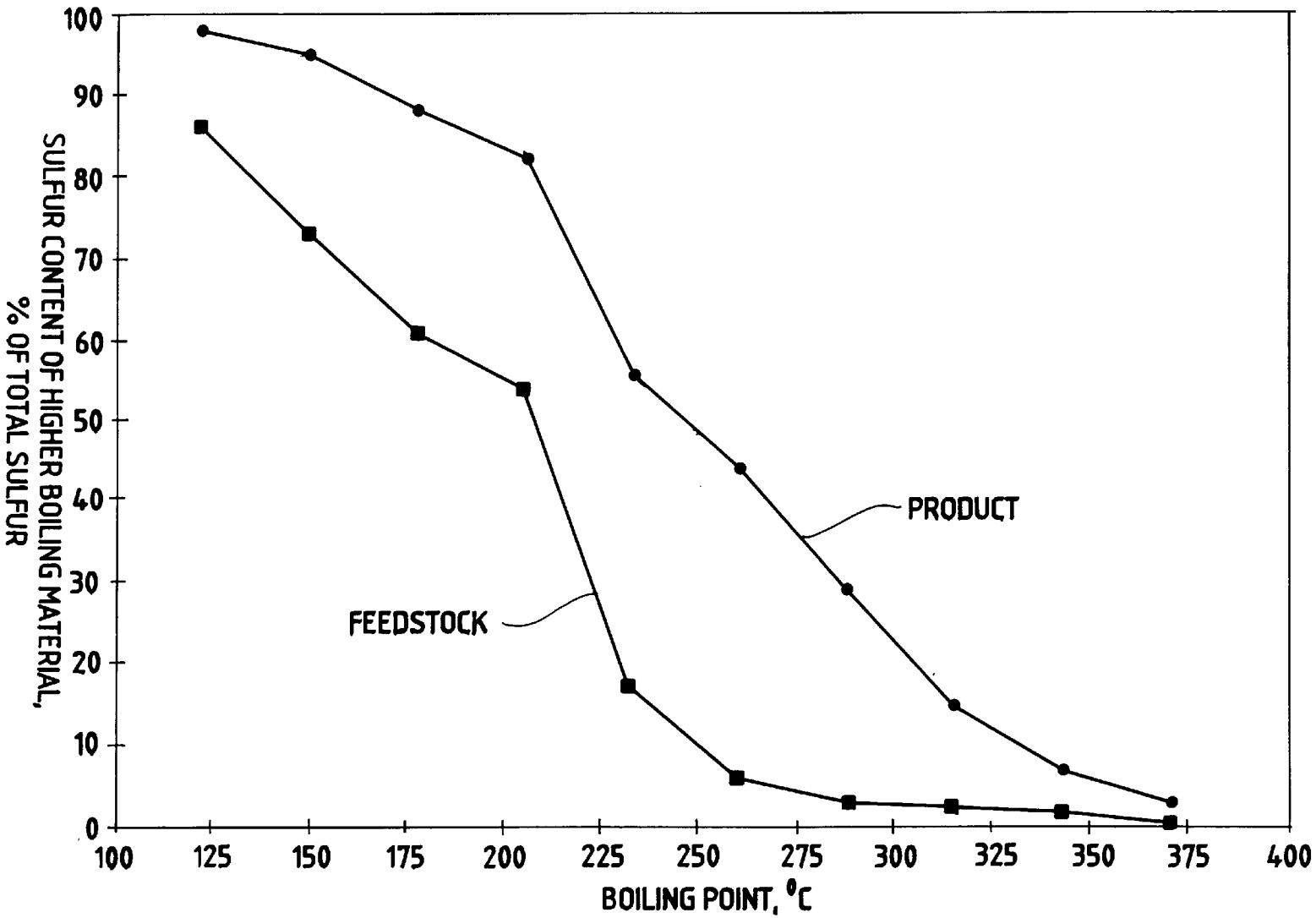
FIG. 2 of the drawings illustrates the use of a solid phosphoric acid catalyst on kieselguhr to increase the boiling point of sulfur-containing impurities in an olefin-containing, stabilized, heavy naphtha feedstock.

The stabilized heavy naphtha was contacted with Catalyst B (solid phosphoric acid catalyst on kieselguhr) at a pressure of 75 atm, a temperature of 204° C. and a space velocity of 1 LHSV. The distribution of sulfur content as a function of boiling point in the feedstock and in the product is set forth in FIG. 2 (boiling point is plotted as a function of the percentage of the total sulfur content which is present in higher boiling fractions). These results demonstrate that the olefin content of this heavy naphtha feedstock from a catalytic cracking process is sufficiently high to permit conversion of the sulfur-containing impurities to higher boiling sulfur-containing products. It will also be noted that 30% of the sulfur in the product boils above 288° C. in contrast to only about 20% in the product which was obtained when the feedstock was blended with a mixture of propene and butenes as described in Experiment VIII. It is believed that the higher molecular weight olefins present in the feedstock yield sulfur-containing products which are higher in boiling point than the products that are obtained when large amounts of $C_3$ and $C_4$ olefins are added to the feedstock as in Experiment VIII.

EXPERIMENT X

Figure 3A:
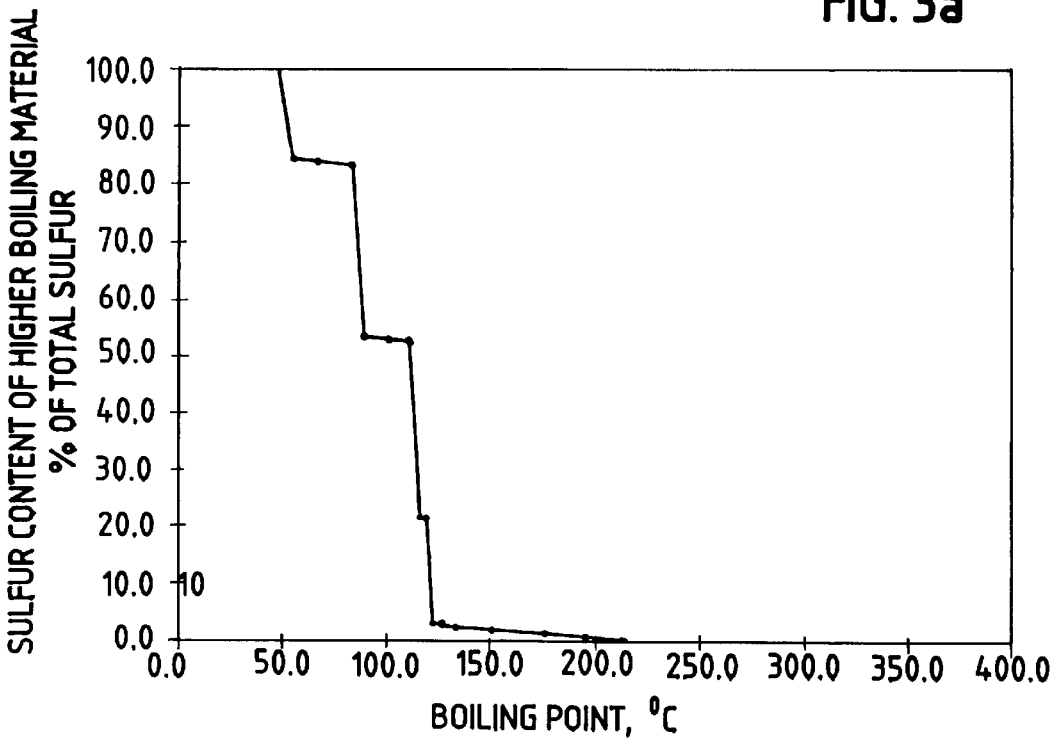
FIG. 3*a* of the drawings illustrates the distribution of sulfur content as a function of boiling point in a low olefin content synthetic hydrocarbon feedstock which contains 2-propanethiol, thiophene, 2-methylthiophene, and isopropyl sulfide as impurities.
Figure 3B:
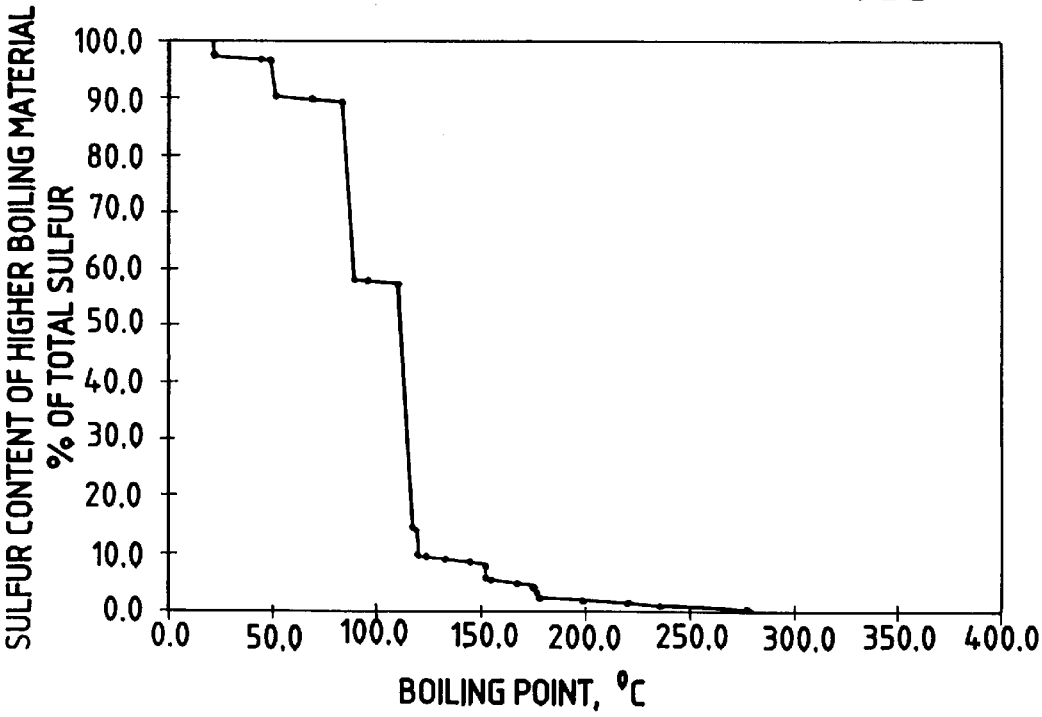
FIG. 3*b* illustrates the use of a solid phosphoric acid catalyst on kieselguhr to increase the boiling point of the sulfur-containing impurities in this synthetic feedstock.

A low olefin content synthetic feedstock having the composition which is set forth in Table III was contacted, as described above, with Catalyst B (solid phosphoric acid catalyst on kieselguhr) at a pressure of 54 atm, a temperature of 204° C., and a space velocity of 2 LHSV. The distribution of sulfur content as a function of boiling point in the low olefin content synthetic feedstock is set forth in FIG. 3*a* (boiling point is plotted as a function of the percentage of the total sulfur content which is present in higher boiling fractions). FIG. 3*b* sets forth the sulfur distribution as a function of boiling point in the product from this feedstock. Comparison of FIGS. 3*a* and 3*b*, demonstrates that there was very little conversion of the sulfur-containing components of the synthetic feedstock to higher boiling sulfur-containing products.

EXPERIMENT XI

Figure 4A:
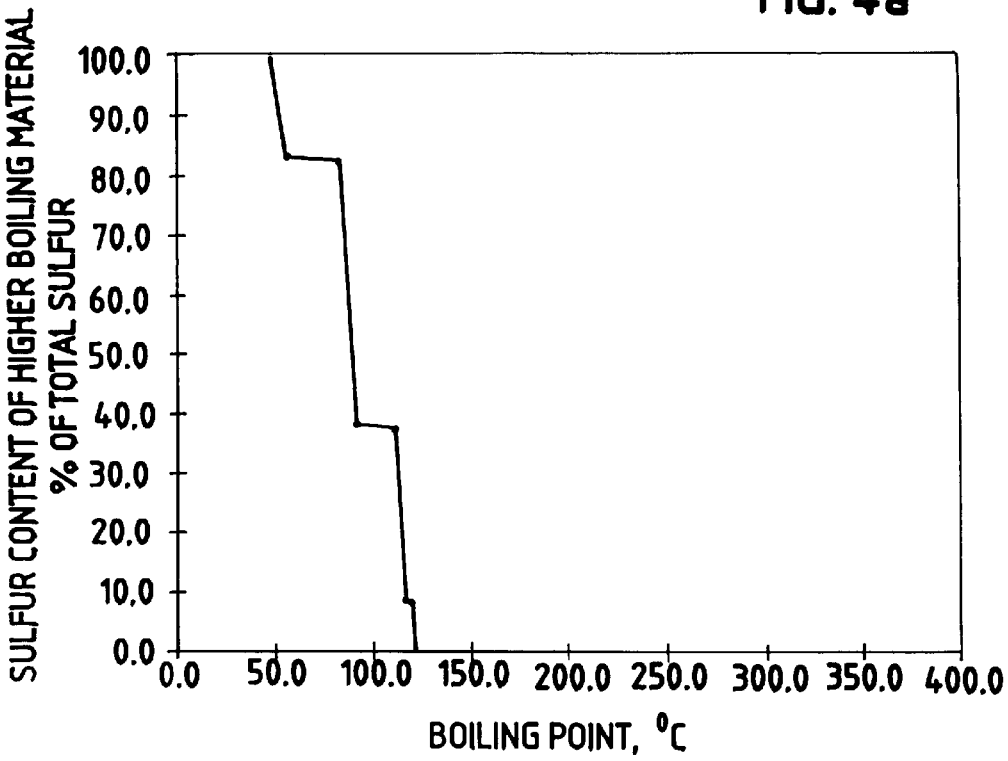
FIG. 4*a* of the drawings illustrates the distribution of sulfur content as a function of boiling point in a high olefin content synthetic hydrocarbon feedstock which contains 2-propanethiol, thiophene, 2-methylthiophene, and isopropyl sulfide as impurities.
Figure 4B:
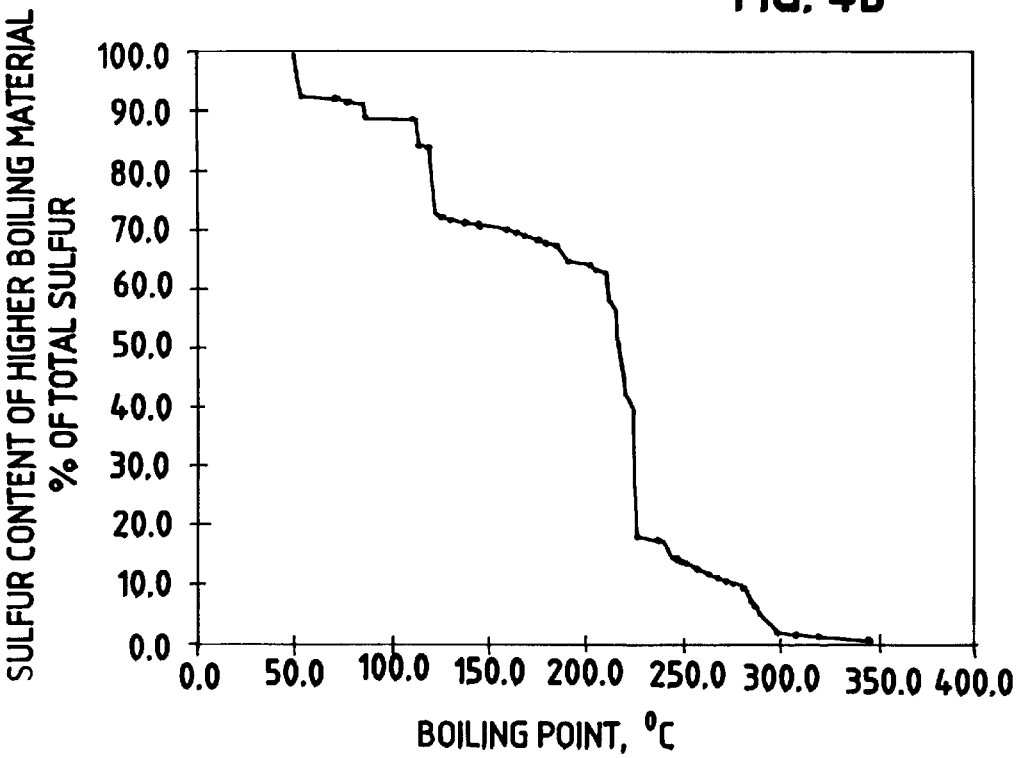
FIG. 4*b* illustrates the use of a solid phosphoric acid catalyst on kieselguhr to increase the boiling point of the sulfur-containing impurities in this synthetic feedstock.

A high olefin content synthetic feedstock having the composition which is set forth in Table III was contacted, as described above, with Catalyst B (solid phosphoric acid catalyst on kieselguhr) at a pressure of 54 atm, a temperature of 204° C., and a space velocity of 2 LHSV. The distribution of sulfur content as a function of boiling point in the high olefin content synthetic feedstock is set forth in FIG. 4*a* (boiling point is plotted as a function of the percentage of the total sulfur content which is present in higher boiling fractions). FIG. 4*b* sets forth the sulfur distribution as a function of boiling point in the product from this feedstock. Comparison of FIGS. 4*a* and 4*b* demonstrates that there was substantial conversion of the sulfur-containing components of the synthetic feedstock to higher boiling sulfur-containing products. Except for olefin content, the high olefin content synthetic feedstock of this experiment has a composition which is very similar to that of the low olefin content synthetic feedstock of Experiment X above. A comparison of the results of this experiment with those of Experiment X will demonstrate that there is very little conversion of the sulfur-containing feedstock components in the absence of the olefins.

EXPERIMENT XII

Catalysts A, B, C, D, E and F, which are described in detail above and whose properties are briefly summarized in Table IV, were each tested as described above at a pressure of 17 atm, a temperature of 204° C., and a space velocity of 2 LHSV with the following two feedstocks: (1) a high olefin content synthetic feedstock having the composition which is set forth in Table m; and (2) the same high olefin content synthetic feedstock after blending with propene at a 0.25 volume ratio of propene to synthetic feedstock.

TABLE IV

Catalyst Characteristics

| Catalyst | Type | Pore Size | Relative Acidity |
|---|---|---|---|
| A | Amberlyst ® 35 Wet | >6Å | Medium |
| B | Solid phosphoric acid on kieselguhr | >6Å | Strong |
| C | ZSM-5 zeolite in alumina matrix | <6Å | Strong |
| D | Beta zeolite in alumina matrix | >6Å | Strong |
| E | Silica-alumina | >6Å | Medium |
| F | Y zeolite in alumina matrix | >6Å | Strong |

Figure 5:
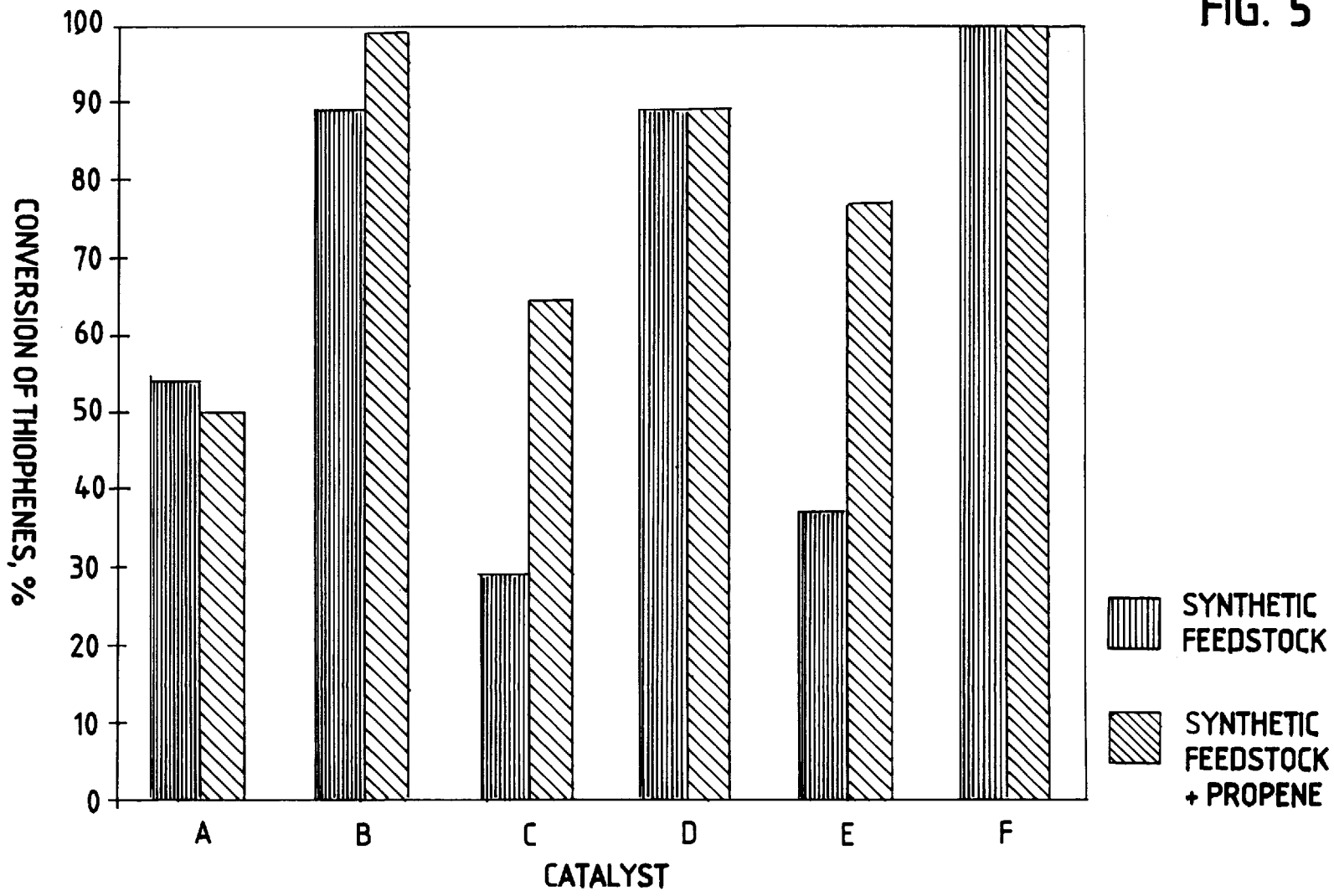
FIG. 5 of the drawings illustrates the ability of six different solid acidic catalysts to increase the boiling point of sulfur-containing impurities in a synthetic feedstock (which contained 12.9 wt. % of $C_6$ and $C_7$ olefins) both before and after the feedstock was blended with propene at a 0.25 volume ratio of propene to synthetic feedstock.

In each such test, the conversion of thiophenes (thiophene and 2-methylthiophene) to other materials was determined from an analysis of the resulting product for thiophene and methylthiophene content. The results of these tests are set forth in FIG. 5. These results suggest that the conversion of thiophene and 2-methylthiophene in the absence of added propene is highest over the most acidic catalysts which have a pore size greater than about 6 Å (Catalysts B, D and F). Although the invention is not to be so limited, these results suggest that the size of the alkylated product may be too large to form in the pores of the catalyst which has a pore size smaller than about 6 Å (Catalyst C) and that the acidity of the moderately acidic catalysts (Catalysts A and E) may be insufficient to fully activate the $C_6$ and $C_7$ olefins of the high olefin synthetic feedstock. However, when propene is added to the synthetic feedstock, the conversion of thiophene and 2-methylthiophene over both Catalyst C (<6 Å pore size) and the moderately acidic Catalyst E is approximately doubled.

EXPERIMENT XIII

A high olefin content synthetic feedstock having the composition which is set forth in Table III was blended with propene at a 0.13 volume ratio of propene to synthetic feedstock, and the resulting blend was contacted with Catalyst B (solid phosphoric acid catalyst on kieselguhr) at a pressure of 54 atm, a temperature of 149° C., and a space velocity of 2 LHSV. This experiment was then repeated at a temperature of 204° C. In each experiment, the conversion of thiophenes (thiophene and 2-methylthiophene), benzene, and toluene to other products was determined from an analysis of the resulting product. At 149° C., the conversion of thiophenes (thiophene and 2-methylthiophene), benzene and toluene was 54%, 15% and 7%, respectively. At 204° C., the conversion of thiophenes (thiophene and 2-methylthiophene), benzene and toluene was 73%, 36% and 26%, respectively. Accordingly, under these conditions, the aromatic sulfur compounds (thiophene and 2-methylthiophene) are converted in preference to the aromatic hydrocarbons (benzene and toluene).

EXPERIMENT XIV

In a series of tests, the stabilized heavy naphtha was blended with varying amounts of a mixed $C_3/C_4$ stream (containing, on a weight basis, 55% propane, 27% propene, 9.5 % 2-butene, 6% 1-butene, 2.5% 2-methylpropene, and 1500 ppm 2-propanol), and the various blends were contacted with Catalyst B (solid phosphoric acid catalyst on kieselguhr) at a pressure of 82 atm, a temperature of 204° C., and a space velocity of 1 LHSV. The ratio by volume of the mixed $C_3/C_4$ stream to naphtha used in these tests is set forth in Table V. The product of each test was analyzed with respect to: (1) the conversion of sulfur-containing impurities to higher boiling sulfur-containing material; and (2) its content of benzene and cumene. These analytical results are also set forth in Table V. The ratio of cumene to benzene in the product is an indicator of the extent to which the aromatic hydrocarbons in the naphtha feedstock have been alkylated under the conditions of each test (the cumene is formed by alkylation of benzene in the naphtha feedstock with propene from the mixed $C_3/C_4$ stream).

TABLE V

Effect of Varying Amounts of Mixed $C_3/C_4$ Olefins on Alkylation of Heavy Naphtha

| Run No. | Volume Ratio of $C_3/C_4$ Stream to Naphtha | Sulfur in Products Boiling above 260° C., wt. % | Weight Ratio of Cumene to Benzene |
|---|---|---|---|
| 1 | 0.02 | 23 | 0.01 |
| 2 | 0.03 | 25 | 0.03 |
| | 0.14 | 23 | 0.04 |
| 4 | 0.24 | 25 | 0.14 |
| 5 | 0.50 | 36 | 0.83 |
| 6 | 1.0 | 42 | 1.6 |

For comparison purposes, the feedstock had a 0.01 weight ratio of cumene to benzene and 5 weight percent of its sulfur content had a boiling point above 260° C. The results indicate that the sulfur-containing impurities can be converted to higher boiling sulfur-containing material in a selective manner which does not cause significant alkylation of the aromatic hydrocarbons which are also in the feedstock.

We claim:

1. A method for producing a product of reduced sulfur content from a feedstock, wherein said feedstock:

(a) is comprised of a mixture of hydrocarbons which boils below about 345° C.;

(b) contains a minor amount of organic sulfur compounds;

(c) contains an amount of alkylating agent which is at least equal on a molar basis to that of the organic sulfur compounds, and wherein said alkylating agent is comprised of at least one material selected from the group consisting of alcohols and olefins; and (d) is substantially free of basic nitrogen-containing impurities;

and wherein said method comprises:

(a) contacting the feedstock with an acidic solid catalyst at a temperature in excess of 100° C. for a contact time which is effective to result in conversion of at least a portion of said organic sulfur compounds to a higher boiling sulfur-containing material; and (b) fractionating the product of said contacting step on the basis of boiling point to remove high boiling sulfur-containing material and produce a product which has a reduced sulfur content relative to that of said feedstock.

2. The method of claim 1 wherein the product of said contacting step is fractionated by fractional distillation to remove high boiling sulfur-containing material and produce a product which has a reduced sulfur content relative to that of said feedstock.

3. The method of claim 2 wherein the organic sulfur compounds in the feedstock are comprised of aromatic sulfur compounds.

4. The method of claim 3 wherein at least about 20% of the aromatic sulfur compounds are converted to higher boiling sulfur-containing material.

5. The method of claim 3 wherein the feedstock is comprised of hydrocarbons from a catalytic cracking process.

6. The method of claim 5 wherein the feedstock is comprised of a treated naphtha which is prepared by removing basic nitrogen-containing impurities from a naphtha produced by a catalytic cracking process.

7. The method of claim 6 wherein the feedstock is prepared by combining said treated naphtha with at least one material selected from the group consisting of olefins of from about 3 to about 10 carbon atoms.

8. The method of claim 6 wherein the feedstock is prepared by combining said treated naphtha with at least one material selected from the group consisting of propene, 2-butene, 1-butene and 2-methylpropene.

9. The method of claim 2 wherein said feedstock is comprised of a naphtha from a catalytic cracking process from which basic nitrogen-containing impurities have been removed.

10. The method of claim 2 wherein said alkylating agent is selected from the group consisting of alcohols and olefins of from about 3 to about 20 carbon atoms.

11. The method of claim 2 wherein said catalyst is a solid phosphoric acid catalyst.

12. The method of claim 2 wherein said feedstock boils below about 230° C.

13. The method of claim 2 wherein said feedstock contains less than 50 weight percent of aromatic hydrocarbons.

14. The method of claim 2 wherein the amount of alkylating agent is at least equal on a molar basis to 5 times that of said organic sulfur compounds.

15. The method of claim 2 wherein said contacting step is carried out at a temperature in the range from about 125° to about 250° C.

16. The method of claim 1 wherein the feedstock is comprised of a liquid.

17. A method for producing a product of reduced sulfur content which comprises:

(a) producing catalytic cracking products which include sulfur-containing impurities by catalytically cracking a hydrocarbon feedstock through contact with a cracking catalyst at a temperature which is effective to convert at least a portion of the feedstock to lower molecular weight products, wherein said feedstock contains sulfur-containing impurities;

(b) separating at least a portion of the catalytic cracking products which is comprised of at least 1 weight percent of olefins and contains organic sulfur compounds as impurities;

(c) producing a secondary feedstock by removing basic nitrogen-containing impurities from the separated catalytic cracking products;

(d) contacting the secondary feedstock with an acidic solid catalyst at a temperature in excess of 50° C. for a period of time which is effective to convert at least a portion of the sulfur-containing impurities in said separated catalytic cracking products to a sulfur-containing material of higher boiling point; and (e) fractionating the product of said contacting step on the basis of boiling point to remove high boiling sulfur-containing material and produce a product which has a reduced sulfur content relative to that of said separated catalytic cracking products.

18. The method of claim 17 wherein the product of said contacting step is fractionated by fractional distillation to remove high boiling sulfur-containing material and produce a product which has a reduced sulfur content relative to that of said separated catalytic cracking products.

19. The method of claim 18 wherein said portion of the catalytic cracking products is separated by distillation.

20. The method of claim 19 wherein said separated portion of the catalytic cracking products boils below about 345° C.

21. The method of claim 20 wherein said separated portion of the catalytic cracking products boils below about 230° C.

22. The method of claim 18 wherein said contacting step is carried out at a temperature and pressure which are effective to maintain the separated catalytic cracking products in a liquid state.

23. The method of claim 18 wherein said contacting step is carried out at a temperature in the range from about 100° to about 350° C.

24. The method of claim 17 which additionally comprises combining said secondary feedstock with at least one material selected from the group consisting of propene, 2-butene, 1-butene and 2-methylpropene before said contacting with the acidic solid catalyst.

25. A method for producing a product of reduced sulfur content which comprises:

(a) producing catalytic cracking products by catalytically cracking a hydrocarbon feedstock through contact with a cracking catalyst at a temperature which is effective to convert at least a portion of the feedstock to lower molecular weight products, wherein said feedstock contains sulfur-containing impurities;

(b) passing the catalytic cracking products to a distillation unit and fractionating said catalytic cracking products into at least two fractions which comprise: (1) a fraction boiling below about 345° C. which contains sulfur-containing impurities and (2) a fraction of higher boiling point;

(c) producing a treated material by contacting a portion of said fraction (1) from the distillation unit with an acidic solid catalyst at a temperature in excess of 50° C. for a period of time which is effective to convert at least a portion of the sulfur-containing impurities in said fraction (1) to a sulfur-containing material of higher boiling point; and (d) returning the treated material to said distillation unit and fractionating the treated material simultaneously with the catalytic cracking products, whereby at least a portion of the sulfur-containing material of higher boiling point in the treated material is removed and a product of reduced sulfur content is produced.

26. The method of claim 25 wherein from about 5% to about 90% by volume of said fraction (1) from said distillation unit is contacted with the acidic solid catalyst in said contacting step.

27. The method of claim 25 wherein said fraction (1) from the distillation unit is a liquid boiling below about 230° C.

28. The method of claim 25 which additionally comprises combining the portion of said fraction (1) from the distillation unit with at least one material selected from the group consisting of propene, 2-butene, 1-butene and 2-methylpropene before contacting with the acidic solid catalyst.

29. A method for producing a product of reduced sulfur content from a feedstock, wherein said feedstock:

(a) is comprised of a mixture of hydrocarbons which boils below about 345° C.;

(b) contains a minor amount of organic sulfur compounds; and (c) contains an amount of alkylating agent which is at least equal on a molar basis to that of the organic sulfur compounds, and wherein said alkylating agent is comprised of at least one material selected from the group consisting of alcohols and olefins;

and wherein said method comprises:

(a) contacting the feedstock with a solid phosphoric acid catalyst at a temperature in excess of 100° C. for a contact time which is effective to result in conversion of at least a portion of said organic sulfur compounds to a higher boiling sulfur-containing material; and (b) fractionating the product of said contacting step on the basis of boiling point to remove high boiling sulfur-containing material and produce a product which has a reduced sulfur content relative to that of said feedstock.

30. The method of claim 29 wherein the organic sulfur compounds in the feedstock are comprised of aromatic sulfur compounds.

31. The method of claim 29 wherein said feedstock is a naphtha from a catalytic cracking process.

32. The method of claim 31 which additionally comprises combining the feedstock with an additional alkylating agent before said contacting with the solid phosphoric acid catalyst, and wherein said additional alkylating agent is comprised of at least one material selected from the group consisting of propene, 2-butene, 1-butene and 2-methylpropene.

33. A method for producing a product of reduced sulfur content from a feedstock, wherein said feedstock:

(a) is comprised of a naphtha from a catalytic cracking process;

(b) contains a minor amount of organic sulfur compounds; and (c) contains an amount of alkylating agent which is at least equal on a molar basis to that of the organic sulfur compounds, and wherein said alkylating agent is comprised of at least one material selected from the group consisting of alcohols and olefins;

and wherein said method comprises:

(a) contacting the feedstock with an acidic solid catalyst at a temperature in excess of 100° C. for a contact time which is effective to result in conversion of at least a portion of said organic sulfur compounds to a higher boiling sulfur-containing material; and (b) fractionating the product of said contacting step on the basis of boiling point to remove high boiling sulfur-containing material and produce a product which has a reduced sulfur content relative to that of said feedstock.

34. The method of claim 33 wherein the organic sulfur compounds in the feedstock are comprised of aromatic sulfur compounds.

35. The method of claim 33 wherein said feedstock is comprised of a mixture of said naphtha with at least one material selected from the group consisting of propene, 2-butene, 1-butene and 2-methylpropene.

36. A method for producing a product of reduced sulfur content from a feedstock, wherein said feedstock:

(a) is comprised of a mixture of hydrocarbons which boils below about 345° C.;

(b) contains a minor amount of organic sulfur compounds; and (c) contains an amount of alkylating agent which is at least equal on a molar basis to that of the organic sulfur compounds, and wherein said alkylating agent is comprised of at least one material selected from the group consisting of alcohols and olefins;

and wherein said method comprises:

(a) contacting the feedstock with a solid acidic polymeric resin catalyst at a temperature in excess of about 50° C. for a contact time which is effective to result in conversion of at least a portion of said organic sulfur compounds to a higher boiling sulfur-containing material; and (b) fractionating the product of said contacting step on the basis of boiling point to remove high boiling sulfur-containing material and produce a product which has a reduced sulfur content relative to that of said feedstock.

37. The method of claim 36 wherein the organic sulfur compounds in the feedstock are comprised of aromatic sulfur compounds.

38. The method of claim 36 wherein said feedstock is a naphtha from a catalytic cracking process.

39. The method of claim 38 which additionally comprises combining the feedstock with an additional alkylating agent before said contacting with the solid acidic polymeric resin catalyst, and wherein said additional alkylating agent is comprised of at least one material selected from the group consisting of propene, 2-butene, 1-butene and 2-methylpropene.

* * * * *

UNITED STATES PATENT AND TRADEMARK OFFICE

CERTIFICATE OF CORRECTION

PATENT : 6,048,451

DATED : April 11, 2000

INVENTOR(S) : George A. Huff, Jr., Bruce D. Alexander, Douglas N. Rundell, William J. Reagan, Ozie S. Owen, and Jin S. Yoo

It is certified that error appears in the above-identified patent and that said Letters Patent is hereby corrected as shown below:

Column 10, line 34, "ZSM4" should read --ZSM-4--.

Column 19, line 39, "forth in Table m" should read --forth in Table III--.

Column 20, line 63, the line of Table V reading:

| | | | | |
|---|---|---|---|---|
| | " | 0.14 | 23 | 0.04" |
| should read: | --3 | 0.14 | 23 | 0.04--. |

Signed and Sealed this

Twentieth Day of March, 2001

Nicholas P. Godici

*Attest:*

NICHOLAS P. GODICI

*Attesting Officer*

*Acting Director of the United States Patent and Trademark Office*